US007895862B2

(12) United States Patent
Lonati et al.

(10) Patent No.: US 7,895,862 B2
(45) Date of Patent: Mar. 1, 2011

(54) KNITTING MACHINE WITH LATCH NEEDLES AND WITHOUT SINKERS

(75) Inventors: Tiberio Lonati, Brescia (IT); Ettore Lonati, Botticino (IT); Fausto Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/308,693

(22) PCT Filed: Jul. 3, 2007

(86) PCT No.: PCT/EP2007/005881

§ 371 (c)(1),
(2), (4) Date: Dec. 22, 2008

(87) PCT Pub. No.: WO2008/003463

PCT Pub. Date: Jan. 10, 2008

(65) Prior Publication Data

US 2009/0314038 A1 Dec. 24, 2009

(30) Foreign Application Priority Data

Jul. 7, 2006 (IT) ..... MI2006A1320
May 30, 2007 (IT) ..... MI2007A1096

(51) Int. Cl.
*D04B 15/00* (2006.01)

(52) U.S. Cl. ..... 66/104

(58) Field of Classification Search ..... 66/104, 66/106, 91–93, 109
See application file for complete search history.

(56) References Cited

U.S. PATENT DOCUMENTS 3,643,472 A 2/1972 Apprich
3,754,416 A 8/1973 Apprich
3,913,356 A * 10/1975 Suppe ..... 66/93
4,576,018 A * 3/1986 Schindele ..... 66/106
4,693,092 A * 9/1987 Plath ..... 66/55
4,741,181 A * 5/1988 Plath ..... 66/104
4,751,829 A * 6/1988 Plath ..... 66/13
5,163,305 A 11/1992 Tenconi
6,401,495 B2 * 6/2002 Eppler et al. ..... 66/106

FOREIGN PATENT DOCUMENTS

CN 1800466 A 7/2006
EP 0 683 257 A1 11/1995
EP 2038460 3/2009
WO WO 95/07382 A 3/1995

* cited by examiner

*Primary Examiner*—Danny Worrell
(74) *Attorney, Agent, or Firm*—Modiano & Associati; Daniel O'Byrne; Albert Josif

(57) ABSTRACT

A knitting machine with latch needles and without sinkers comprising, in regions of the needle holder comprised between two contiguous slots which accommodate a corresponding needle, a knitting retention element with a portion forming a stop shoulder for the knitting; the knitting retention element can move on command from a first position, of no interference with the knitting formed, to a second position, of it insertion with the portion between two contiguous needles in a region which faces the knitting forming plane, such as retain the knitting portion lying between two contiguous needles, contrasting the entrainment of the knitting along the needles during extraction motion of the needles from the needle holder to release, onto their shank, the previously formed loop of knitting and/or to engage the yarn delivered at a feed or drop of the machine.

29 Claims, 13 Drawing Sheets

KNITTING MACHINE WITH LATCH NEEDLES AND WITHOUT SINKERS

The present invention relates to a knitting machine with latch needles and without sinkers.

BACKGROUND OF THE INVENTION

As is known, knitting machines with latch needles are generally equipped with sinkers which cooperate with the needles in forming knitting.

More particularly, sinkers define a knitting forming plane on which the portion of knitting that lies between two contiguous needles rests while said needles, after engaging the thread at a feed or drop of the machine, retract into the needle holder in order to form a new loop of knitting and lower the previously formed loop of knitting and tension the loop of knitting on the shank of the needle while said needle is extracted with its tip and with part of its shank from the needle holder of the machine in order to engage the thread dispensed at a feed or drop of the machine and form a new loop of knitting. The engagement of the sinkers with the knitting which achieves tensioning of the loop of knitting on the shank of the needle, in this step, also prevents the loop of knitting from following the needle in its extraction movement and achieves assuredly the opening of the latch and the passage of the loop below said latch. The knitting loop tensioning action on the shank of the needle by the sinkers is generally assisted by traction of the already-formed knitted fabric, which is performed generally by means of pneumatic traction devices in small-diameter circular machines and by means of mechanical devices in the other machines.

Usually, the sinkers are located in appropriately provided slots which are formed, at the end of the needle holder from which the needles protrude to engage the thread at a feed or drop of the machine, directly in the needle holder or in a supporting element which is fixed to the needle holder. The sinkers are generally actuated by means of appropriately provided cams, which face the region of the needle holder in which the sinkers are accommodated and define paths which can be engaged by heels of the sinkers, which protrude from the needle holder, as a consequence of a movement of the needle holder with respect to such cams.

In many types of high-gauge knitting machine, in which the space between the needles is extremely reduced, there are no sinkers.

In these machines, the absence of the sinkers, forced by size requirements, causes problems and drawbacks. The absence of the sinkers, during accidental breakage of the yarn being knitted, in fact prevents automatic resumption of the formation of knitting and forces manual intervention to release the new loops of knitting on the shank of the needles which, as a consequence of the breakage of the thread, have lost the knitting.

Moreover, owing to the fact that in these machines the tensioning action of the loops of knitting on the shank of the needles while said needles are extracted with their tip from the needle holder to engage the thread at a feed or drop of the machine is performed exclusively by the fabric tensioning device, this tension can be insufficient, also due to the large number of needles which engage the knitting, to ensure the passage of the loops of knitting below the latch of the needles while said needles are extracted from the needle holder, causing knitting errors.

In order to limit these problems, in some cases these machines are actuated by moving to knit in each instance, at a feed or drop of the machine, only one needle of every two contiguous needles, so that the needle that is not used to form knitting performs a retention action on the loops of knitting formed by the contiguous needles which are made to knit. However, this solution has the drawback of not allowing to use fully the production potential of the machine.

SUMMARY OF THE INVENTION

The aim of the present invention is to provide a knitting machine with latch needles and without sinkers which ensures the correct formation of knitting without thereby limiting the needles that knit, thus allowing to utilize fully its production potential.

Within the scope of this aim, an object of the invention is to provide a knitting machine which ensures high reliability in operation even if it has a very high gauge.

Another object of the invention is to provide a machine which allows automatic resumption of knitting even in case of accidental loss of the yarn on the part of the needles.

This aim and these and other objects which will become better apparent hereinafter are achieved by a knitting machine with latch needles and without sinkers, comprising a needle holder on one face of which there are multiple side-by-side slots which are open at one of their longitudinal ends on a side of the needle holder which defines the knitting forming plane, each slot accommodating a needle which can be actuated with a reciprocating motion along the corresponding slot with an extraction motion, by means of which the needle is extracted from the needle holder with its tip and with a portion of its shank through said longitudinal end of the corresponding slot in order to release, onto its shank, the previously formed loop of knitting and/or engage the yarn or yarns dispensed at a feed or drop of the machine, and with a retraction motion, by means of which the needle is made to retract with its tip into the corresponding slot in order to form a new loop of knitting by lowering the loop of knitting previously formed in order to produce knitting, characterized in that it comprises, in at least part of the regions of the needle holder comprised between two contiguous slots, elements for retaining the knitting, each of which has a portion which forms a stop shoulder for the knitting, each knitting retention element being movable on command from a first position, in which it does not interfere with the knitting being formed, to a second position, in which it is inserted with said portion between two contiguous needles in a region which faces said knitting forming plane, in order to retain the portion of knitting that lies between two contiguous needles, contrasting the entrainment of the knitting along the needles during the extraction motion of said needles, actuation means being provided for actuating said knitting retention element for its passage from said first position to said second position and vice versa in a manner which is coordinated with the actuation of the contiguous needles.

BRIEF DESCRIPTION OF THE DRAWINGS

Further characteristics and advantages of the invention will become better apparent from the description of two preferred but not exclusive embodiments of the machine according to the invention, illustrated by way of non-limiting example in the accompanying drawings, wherein:

FIG. 1 is a schematic sectional view of a machine according to the invention, taken along a plane which is parallel to the sides of the slots of the needle holder, with the knitting retention element in the first position;

FIG. 2 is a schematic sectional view of the machine according to the invention, similar to FIG. 1, with the knitting retention element in the second position;

FIG. 3 is a sectional view of FIG. 2, taken along the line III-III;

FIG. 4 is a schematic and partially exploded perspective view of a portion of the machine according to the invention;

FIG. 5 is a schematic perspective view of a portion of the machine according to the invention with some elements omitted for the sake of greater clarity and illustrating a needle, two knitting retention elements, and the corresponding actuation means, shown in an exploded view;

FIG. 6 is a schematic perspective view of a portion of the machine according to the invention, with some elements omitted for the sake of greater clarity and with two knitting retention elements in the first position;

FIG. 7 is a schematic sectional view of a portion of the machine according to the invention, taken along a plane which is parallel to the sides of a slot of the needle holder which accommodates a needle with the knitting retention elements in the first position;

FIG. 8 is a schematic enlarged-scale sectional view of FIG. 7, taken along the line VIII-VIII, with the means for actuating the knitting retention elements omitted;

FIG. 9 is a sectional view of a portion of the machine according to the invention, similar to FIG. 7, with the knitting retention elements in the second position;

FIG. 10 is a sectional view of two knitting retention elements, similar to FIGS. 7 and 9;

FIG. 11 is a side elevation view of two knitting retention elements;

FIG. 12 is a perspective view of a constructive variation of the knitting retention elements;

FIG. 13 is a side elevation view of the constructive variation of the knitting retention elements of FIG. 12;

FIG. 14 is a sectional view, similar to FIG. 8, of the machine with knitting retention elements of the type shown in FIGS. 12 and 13 fitted thereon;

FIG. 15 is a schematic perspective view of a portion of the machine according to the invention, in a constructive variation of the needle holder, with some elements omitted for the sake of greater clarity and with some needles and two knitting retention elements of the type shown in FIGS. 5 to 11 shown in exploded view;

FIG. 16 is a schematic perspective view of a portion of the machine according to the invention, in the constructive variation of the needle holder shown in FIG. 15, with some elements omitted for the sake of greater clarity and with two knitting retention elements in the first position.

DESCRIPTION OF THE PREFERRED EMBODIMENTS

Figure 1:
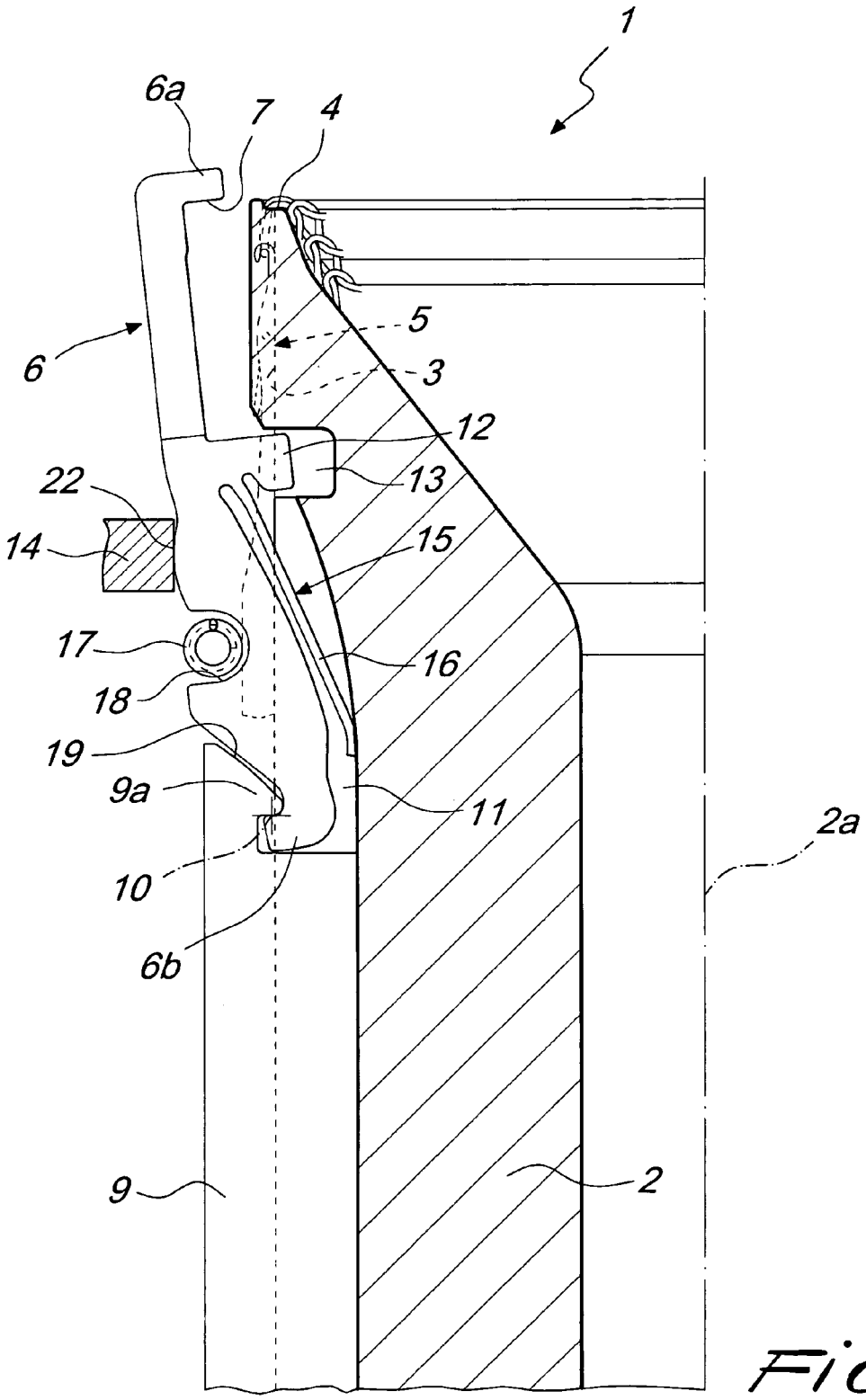
FIGS. 1 to 4 are views of the machine according to the invention in a first embodiment, and more particularly.

The embodiments shown in the cited figures refer to circular single-bed knitting machines, but the solution according to the invention may also be adopted in double-bed knitting circular knitting machines and in rectilinear knitting machines.

With reference to the figures, the knitting machine with latch needles and without sinkers according to the invention, generally designated by the reference numerals 1, 101 in the two embodiments and shown only partially for the sake of simplicity, comprises a needle holder 2, 102, on one face of which there are multiple side-by-side slots 3, 103, which are open at one of their longitudinal ends onto a side of the needle holder 2, 102 which forms the knitting forming plane 4, 104, i.e., the plane on which the portions of loop linking knitting rest during the formation of the loops of knitting, as will become better apparent hereinafter.

A needle 5 is arranged in each of the slots 3, 103 and can be actuated in a per se known manner along the corresponding slot 3, 103, with a reciprocating motion which is composed of an extraction motion, by means of which the needle 5 is extracted with its tip 5*a* and with a portion of its shank 5*b* from the longitudinal end of the slot 3, 103 formed in the knitting forming plane 4, 104 to release, onto its shank 5*b*, the previously formed loop of knitting and/or to engage the yarn or yarns dispensed at a feed or drop of the machine, and a retraction motion, by means of which the needle 5 retracts with its tip 5*a* into the slot 3, 103, thus forming a new loop of knitting and lowering the previously formed loop of knitting in order to form knitting.

According to the invention, the machine comprises, in at least part of the regions of the needle holder 2, 102 comprised between two contiguous slots 3, 103 and preferably in each region of the needle holder 2, 102 comprised between two contiguous slots 3, 103, a knitting retention element 6, 106, 156, which has a portion 6*a*, 106*a*, 156*a* which forms a stop shoulder 7, 107, 157 for the knitting. Said knitting retention element 6, 106, 156 can move on command from a first position, in which it does not interfere with the knitting being formed, to a second position, in which it is inserted, with its portion 6*a*, 106*a*, 156*a*, between two contiguous needles 5 in the region which faces the knitting forming plane 4, 104, in order to retain, by means of the stop shoulder 7, 107, 157, the portion of knitting that lies between two contiguous needles 5, so as to contrast the entrainment of the knitting by the needles 5 during their extraction motion. The machine is provided with actuation means for actuating the knitting retention element 6, 106, 156 in order to perform its transfer from the first position to the second position and vice versa in a manner which is coordinated with the actuation of the needles 5.

More particularly, the knitting retention element 6, 106, 156 has a laminar shape and is arranged on a plane which is parallel to the side walls of the slots 3, 103 between which it is arranged. The knitting retention element 6, 106, 156 can oscillate on its plane of arrangement with respect to the needle holder 2, 102 in order to pass from the first position to the second position cited above and vice versa.

The knitting retention element 6, 106, 156 faces the face of the needle holder 2, 102 in which the slots 3, 103 are formed and is arranged on a plane which is substantially perpendicular to said face. If the needle holder 2, 102 is constituted by a cylinder, i.e., if the machine is a circular knitting machine, the knitting retention element 6, 106, 156 is arranged on a radial plane of the cylinder, i.e., on a plane which passes through the axis of the cylinder.

The knitting retention element 6, 106, 156 has a longitudinal end which defines the portion 6*a*, 106*a*, 156*a* and protrudes beyond the knitting forming plane 4, 104. Said longitudinal end of the knitting retention element 6, 106, 156 protrudes toward the needle holder 2, 102, so as to form, with its side directed toward the knitting forming plane 4, 104, the stop shoulder 7, 107, 157.

In the first embodiment, shown in FIGS. 1 to 4, the end 6*b* of the knitting retention element 6 which lies opposite the portion 6*a* is pivoted to a slat or lamina 9 which is fixed to the needle holder 2 in the region thereof comprised between two contiguous slots 3. More particularly, the slat 9 is partially inserted in the face of the needle holder 2 in which the slots 3 are formed between two contiguous slots 3.

The pivoting between the slat 9 and the end 6*b* of the knitting retention element 6 is performed preferably by a hook-shaped portion 9*a*, which is directed toward the needle holder 2, of the slat 9 which mates with the end 6*b*, which is shaped correspondingly like a hook directed away from the needle holder 2, of the knitting retention element 6. In this manner, the knitting retention element 6 is pivoted to the slat 9 about a pivoting axis 10 which is oriented substantially at right angles to the plane of arrangement of the knitting retention element 6, which can oscillate about said pivoting axis 10 with respect to the slat 9 in order to pass from the first position to the second position and vice versa.

The knitting retention element 6 is accommodated, with a portion thereof starting from the end 6*b* which is pivoted to the slat 9, in a containment compartment 11 which is formed in the needle holder 2.

Moreover, the knitting retention element 6 has, on its side directed toward the needle holder 2, in an intermediate region of its extension parallel to the longitudinal extension of the slots 3, a guiding heel 12, which in the transition of the knitting retention element 6 from the first position to the second position is inserted in a compartment 13 which is formed in the face of the needle holder 2 which faces the knitting retention element 6. The guiding heel 12, in the transition of the knitting retention element 6 from the first position to the second position and vice versa, slides between the shanks 5*b* of the two adjacent needles 5.

Figure 3:
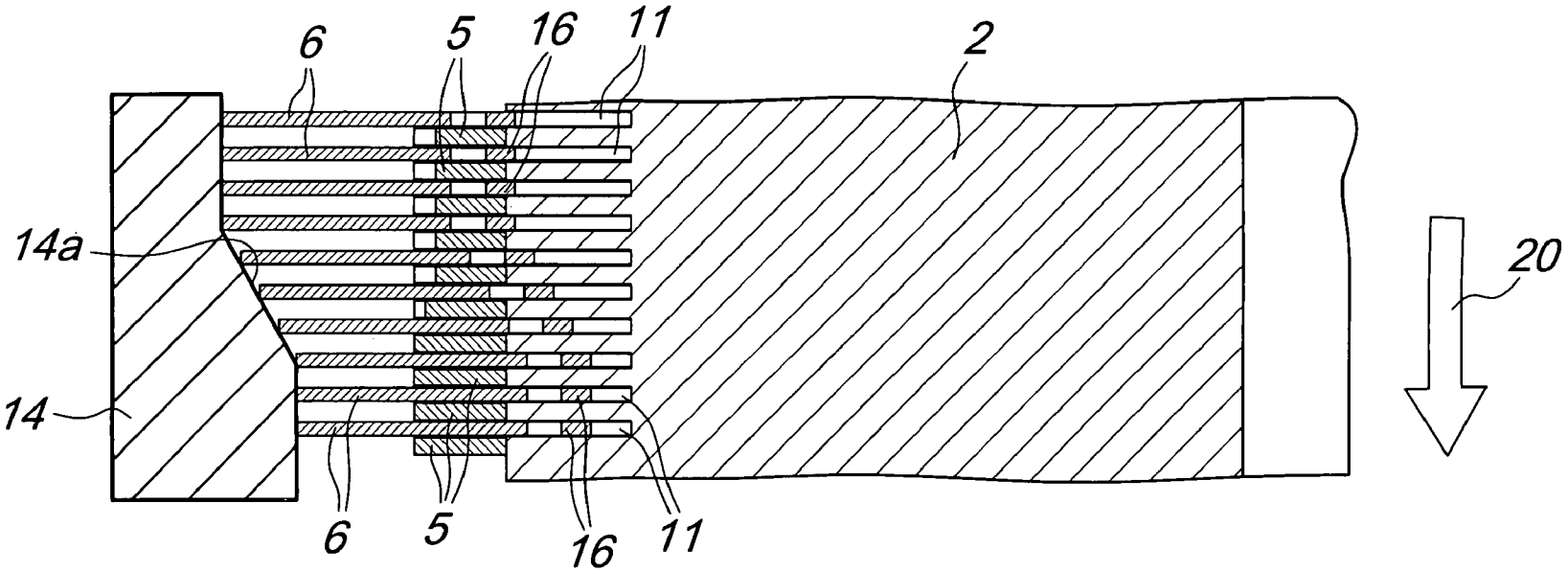
Figure 4:
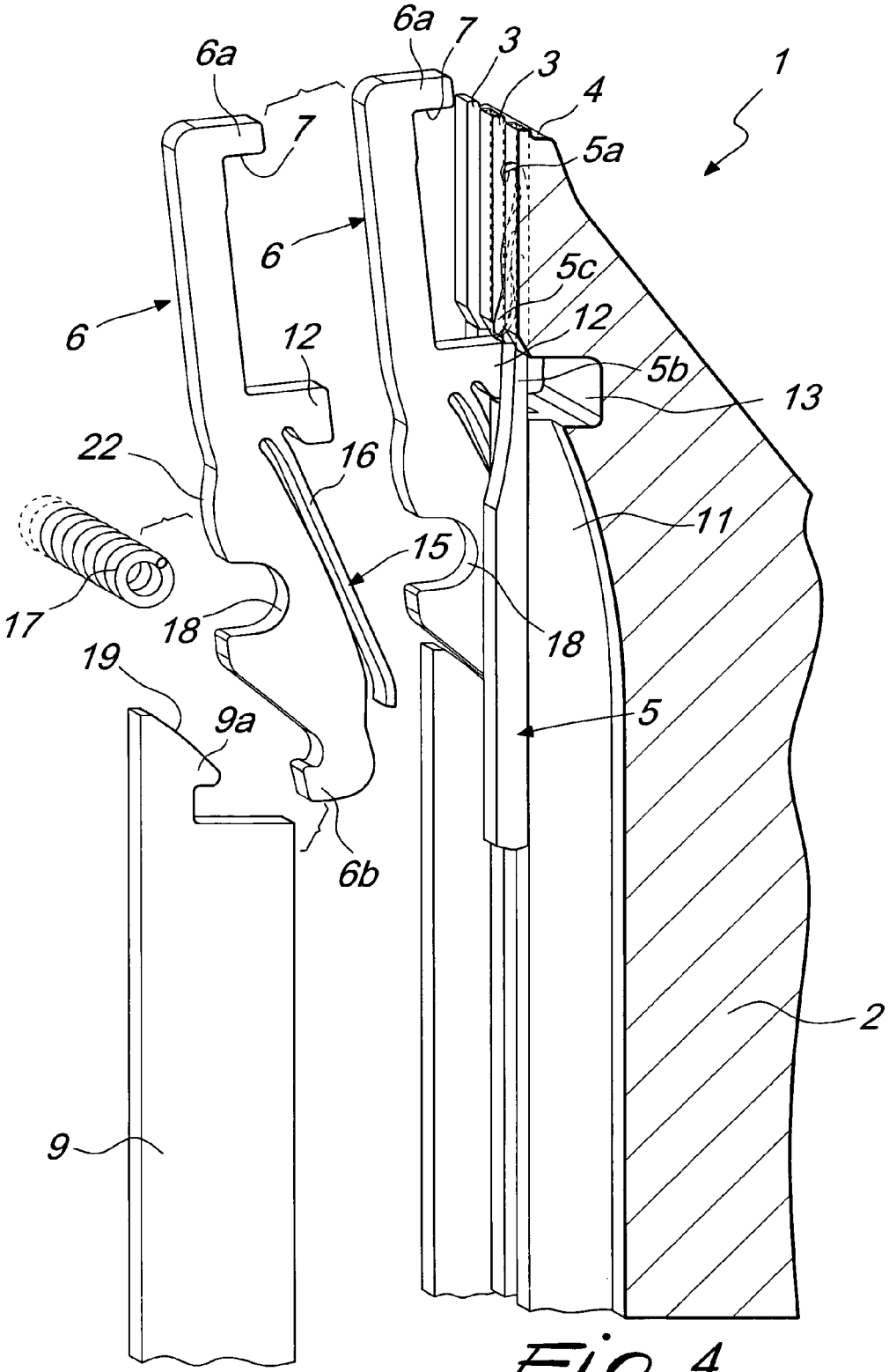

The actuation means for actuating the knitting retention element 6 comprise an actuation cam 14, which faces the side of the knitting retention element 6 which is directed away from the needle holder 2, which can be actuated, in a per se known manner, with respect to the actuation cam 14, along an actuation direction, indicated by the arrow 20 in FIG. 3, which is substantially perpendicular to the longitudinal extension of the slots 3. The actuation cam 14 has an actuation profile 14*a* which gradually approaches the needle holder 2 concordantly with the motion of the needle holder 2 along the actuation direction 20 with respect to the actuation cam 14. The actuation profile 14*a* of the actuation cam 14, during the motion of the needle holder 2 with respect to the actuation cam 14, engages the knitting retention element 6 in a region 22 which is spaced from the pivoting axis 10, causing its rotation about the pivoting axis 10 with respect to the slat 9, in the direction of rotation which moves its end 6*a* toward the needle holder 2, i.e., causing its transition from the first position to the second position cited above.

The actuation cam 14 is arranged so as to act on the knitting retention element when the contiguous needles 5 begin their extraction motion or just before the contiguous needles 5 begin said extraction motion, as will become better apparent hereinafter.

The actuation means of the knitting retention element 6 also comprise elastic means 15, which contrast elastically the passage of the knitting retention element 6 from the first position to the second position caused by the actuation cam 14 and produce, by elastic reaction, the transition of the knitting retention element 6 from the second position to the first position when the action of the actuation cam 14 ceases.

The elastic means 15 are constituted preferably by an elastically flexible wing 16, which is formed monolithically with the knitting retention element 6. The elastically flexible wing 16 extends from the side of the knitting retention element 6 that is directed toward the needle holder 2 and rests against the needle holder 2 in the region comprised between two contiguous slots 3.

More particularly, the elastically flexible wing 16 is connected with one of its ends to the body of the knitting retention element 6 at the connecting region of the guiding heel 12, on the opposite side with respect to the portion 6*a*, and rests, with its opposite end, against the bottom of the containment compartment 11, being arranged along a direction which is inclined with respect to the longitudinal extension of the slots 3 on the opposite side with respect to the knitting forming plane 4.

It should be noted that the nose of the hook-shaped portion 9*a* of the slat 9 forms a support 19 for the end 6*b* of the knitting retention element 6 which mates therewith, and said support 19 delimits the arc of the rotation of the knitting retention element 6 about the pivoting axis 10 in its transition from the second position to the first position. The action of the elastically flexible wing 16 in combination with the support 19 formed by the hook-shaped portion 9*a* has the effect of retaining the knitting retention element 6 in the containment compartment 11 even in the absence of the actuation cam 14.

Preferably, additional means are provided for retaining the knitting retention element 6 and for keeping it within the containment compartment 11 during interventions on the machine which require the removal of the actuation cam 14.

Said additional retention means comprise an elastically extensible wire-like element 17, which is associated with the needle holder 2 and engages the side of the knitting retention element 6 that is directed away from the needle holder 2 in a region which is spaced from the pivoting axis 10. At the region of contact of the wire-like element 17, on the knitting retention element 6 there is a recess 18 in which the wire-like element 17 is inserted.

In the second embodiment, shown in FIGS. 5 to 16, the knitting retention element 106, 156 has, on its side directed toward the needle holder 102, an intermediate portion 121, 171, which is preferably shaped like a circular sector and rests, on the face of the needle holder 102 on which the slots 103 are formed, in the region comprised between two contiguous slots 103. This intermediate portion 121, 171 forms an oscillation axis 110, 160 of the knitting retention element 106, 156 with respect to the needle holder 102. The oscillation axis 110, 160 is oriented substantially at right angles to the plane of arrangement of the knitting retention element 106, 156, which can oscillate about said oscillation axis 110, 160 with respect to the needle holder 102 in order to pass from the first position to the second position or vice versa.

The actuation means for actuating the knitting retention element 106, 156 to produce its transition from the first position to the second position or vice versa comprise at least one actuation cam 114, which faces the face of the needle holder 102 on which the slots 103 are provided. The needle holder 102 can be actuated, along an actuation direction which is substantially perpendicular to the longitudinal extension of the slots 103, with respect to the actuation cam 114, and said actuation cam 114 has a profile 114*a*, 114*b* which is contoured so as to act alternately on the knitting retention element 106, 156 in two regions 122*a*, 122*b*, 172*a*, 172*b* arranged on mutually opposite sides relative to the oscillation axis 110, 160 in order to produce the oscillation of the knitting retention element 106, 156 about the oscillation axis 110, 160 with respect to the needle holder 102 in one direction or in the opposite direction for the transition of the knitting retention element 106, 156 from the first position to the second position or vice versa.

In the second embodiment being described, there is a single actuation cam 114 with a double profile 114*a*, 114*b*, but it is possible to provide two separate actuation cams, each having a corresponding profile 114*a*, 114*b* which acts respectively on the region 122*a*, 172*a* or on the region 122*b*, 172*b* of the knitting retention element 106, 156.

The profiles 114*a*, 114*b* are contoured so as to progressively move toward and away from the needle holder 102 concordantly with the direction of actuation of the needle holder 102 with respect to the actuation cam 114 or the actuation cams. More particularly, the profile 114*a* has a portion which approaches progressively the needle holder 102 at a portion of the profile 114*b* which moves progressively away from the needle holder 102 and a portion which moves progressively away from the needle holder 102 at a portion of the profile 114*b* which approaches progressively the needle holder 2 so that the profile 114*a* causes the oscillation of the knitting retention element 106, 156 about the oscillation axis 110, 160 for its transition from the first position to the second position while the profile 114*b* allows this oscillation, and so that the profile 114*b* causes the oscillation of the knitting retention element 106, 156 about the oscillation axis 110, 160 for its transition from the second position to the first position while the profile 114*a* allows this oscillation.

Conveniently, means are provided for retaining the knitting retention element 106, 156 so as to keep it with its intermediate portion 121, 171 in contact with the needle holder 102 when the actuation cam 114 is removed during maintenance. These retention means comprise a wire-like element 117, which is elastically extensible and is constituted for example by a spring wire, which is associated with the needle holder 102 and engages the side of the knitting retention element 106, 156 which is directed away from the needle holder 102. Preferably, on said side of the knitting retention element 106, 156, in an intermediate region at the portion 121, 171, there is a recessed seat 118, 168 in which the wire-like element 117 rests.

The slots 103 are preferably delimited, at least proximate to the knitting forming plane 104, by laminas 123 which are inserted in mutually parallel slits 124 formed in the body of the needle holder 102. Said laminas 123 protrude from the body of the needle holder 102 and each needle 5 is arranged between two contiguous laminas 123.

Figure 5:
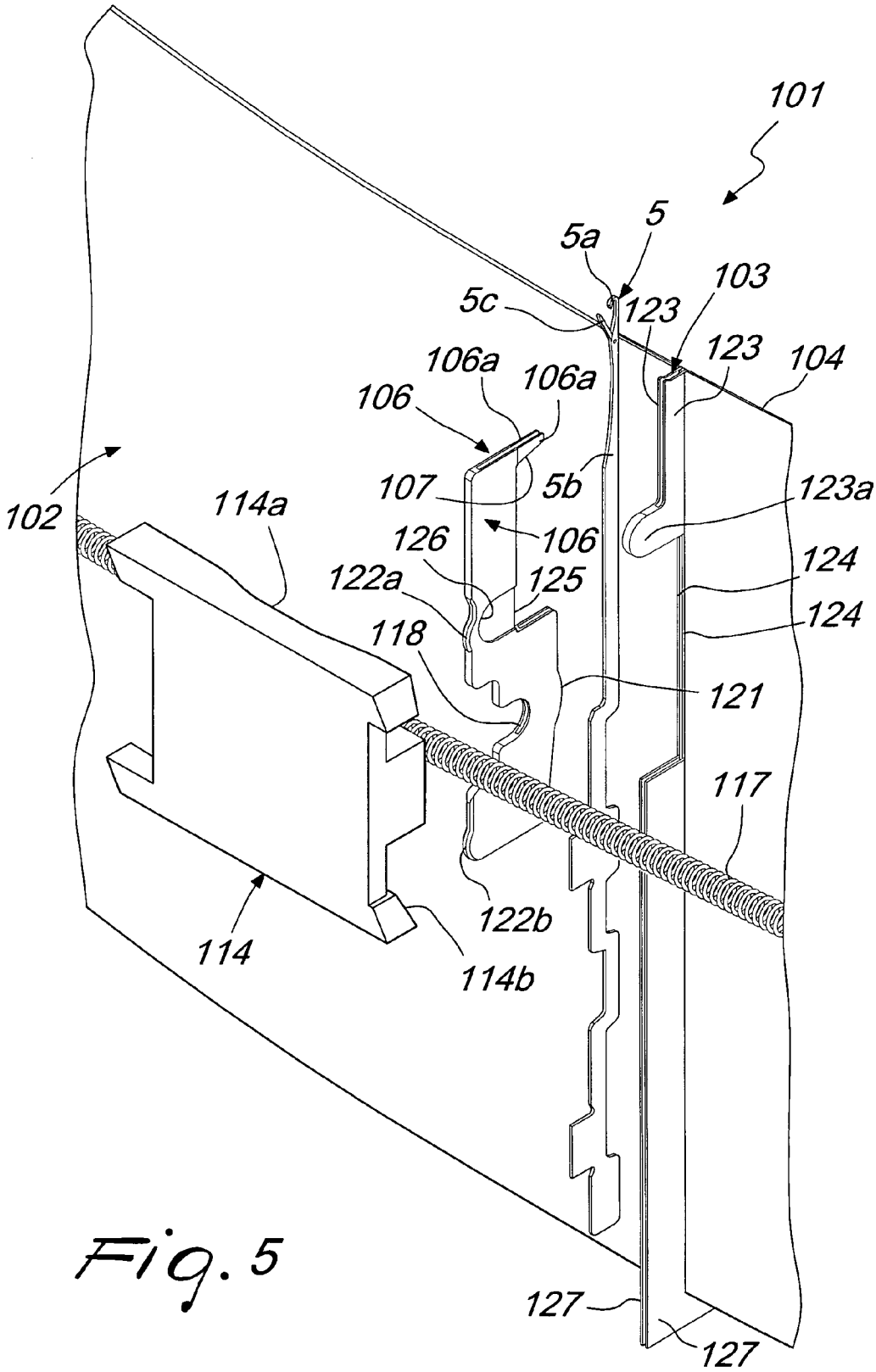
FIGS. 5 to 16 are views of the machine according to the invention in a second embodiment, and more particularly.
Figure 6:
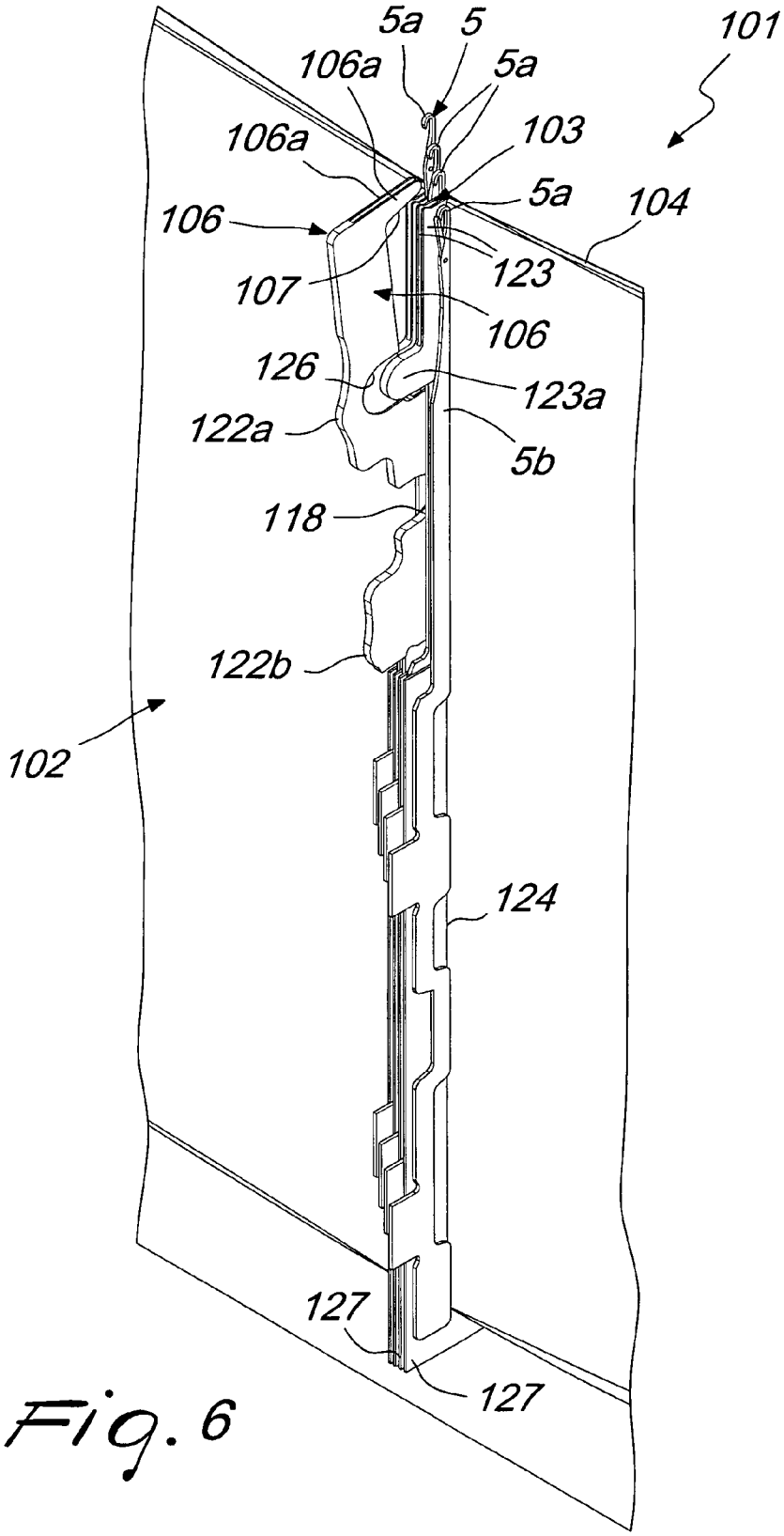
Figure 15:
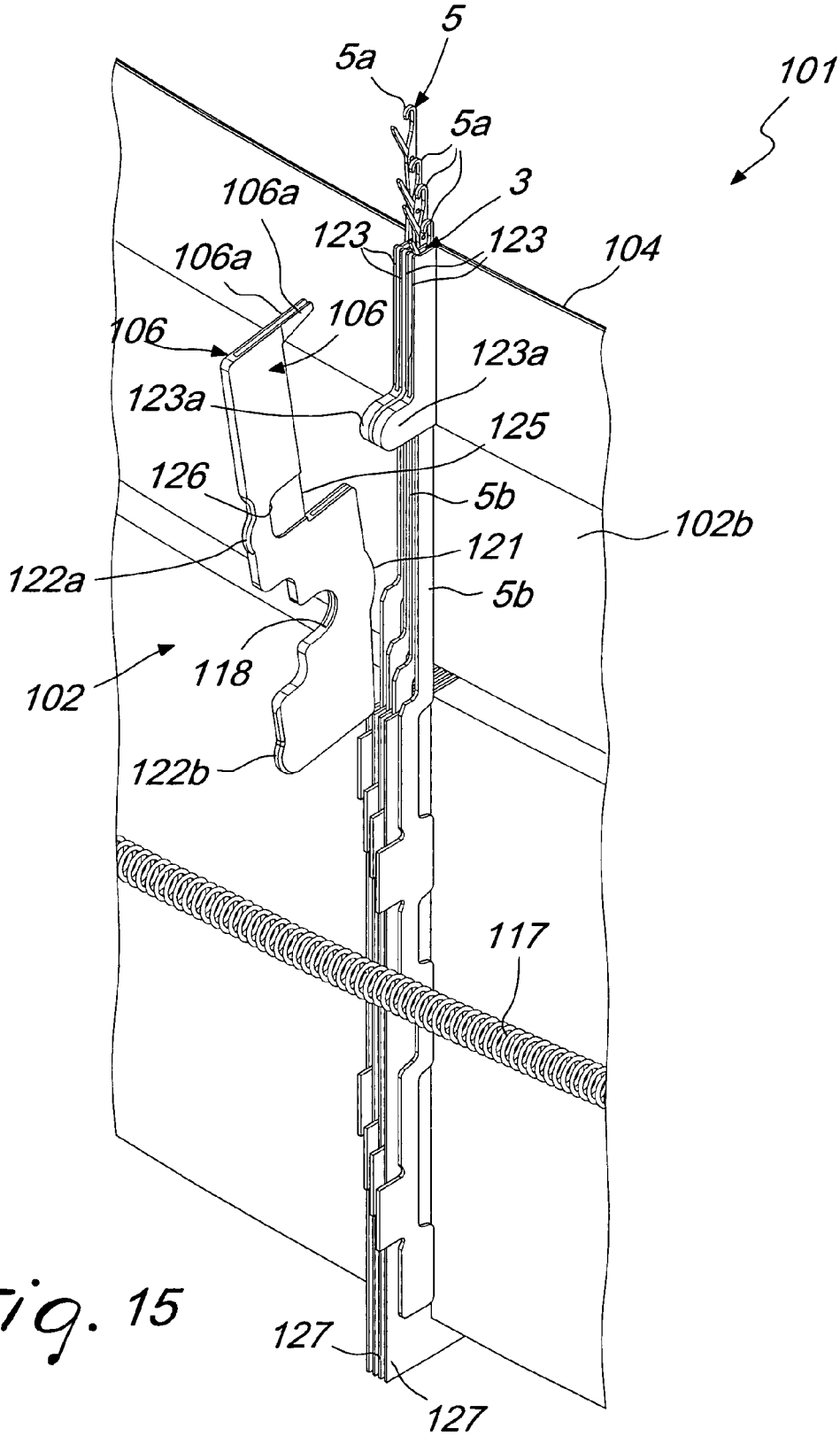
Figure 16:
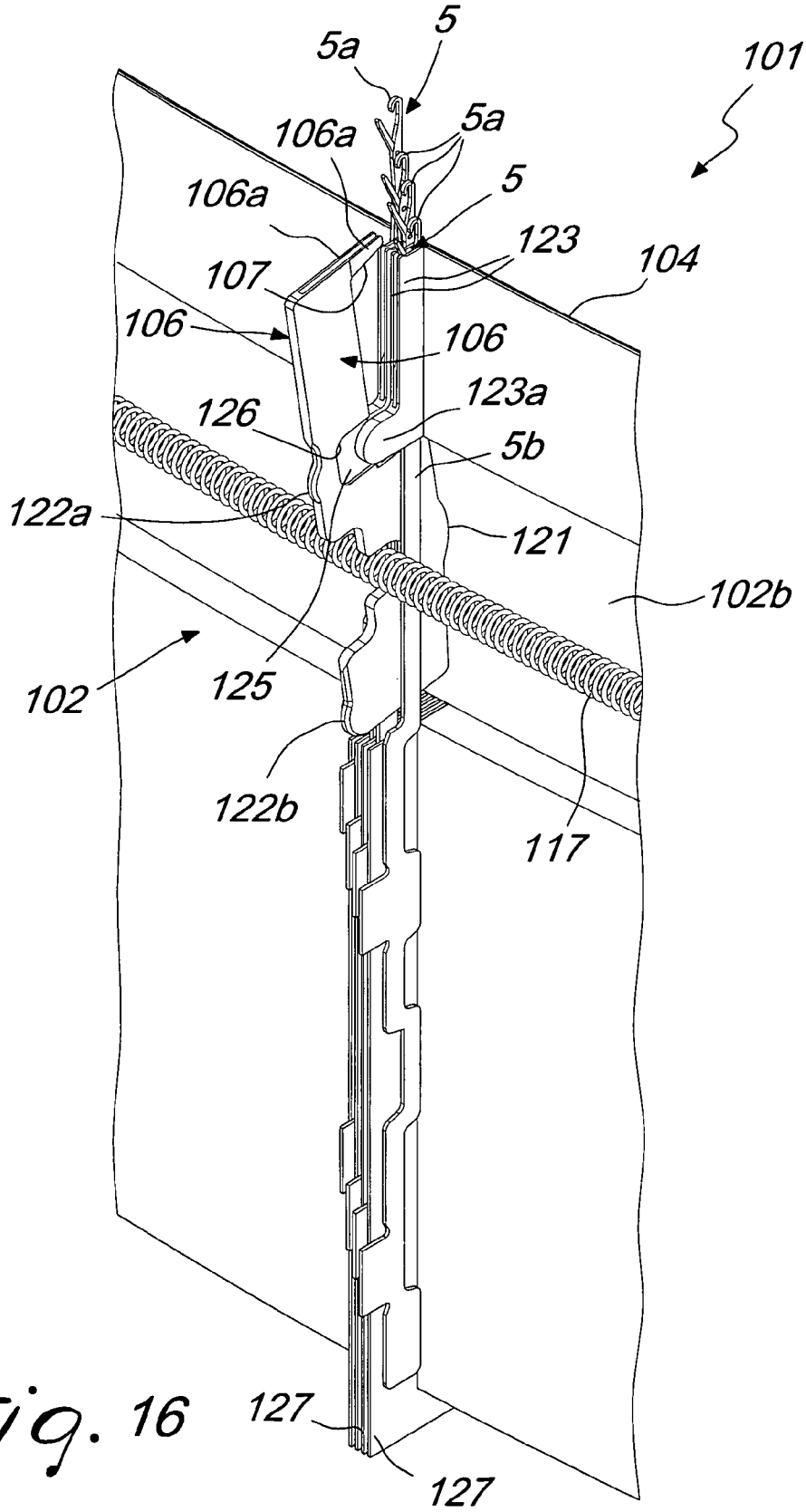

For the sake of simplicity and greater clarity, FIG. 5 shows only two laminas 123 and FIGS. 6, 15 and 16 show only four laminas 123, without altering the fact that the slits 124 and the laminas 123 are distributed along the entire face of the needle holder 102 in order to form the slots 3.

Figure 7:
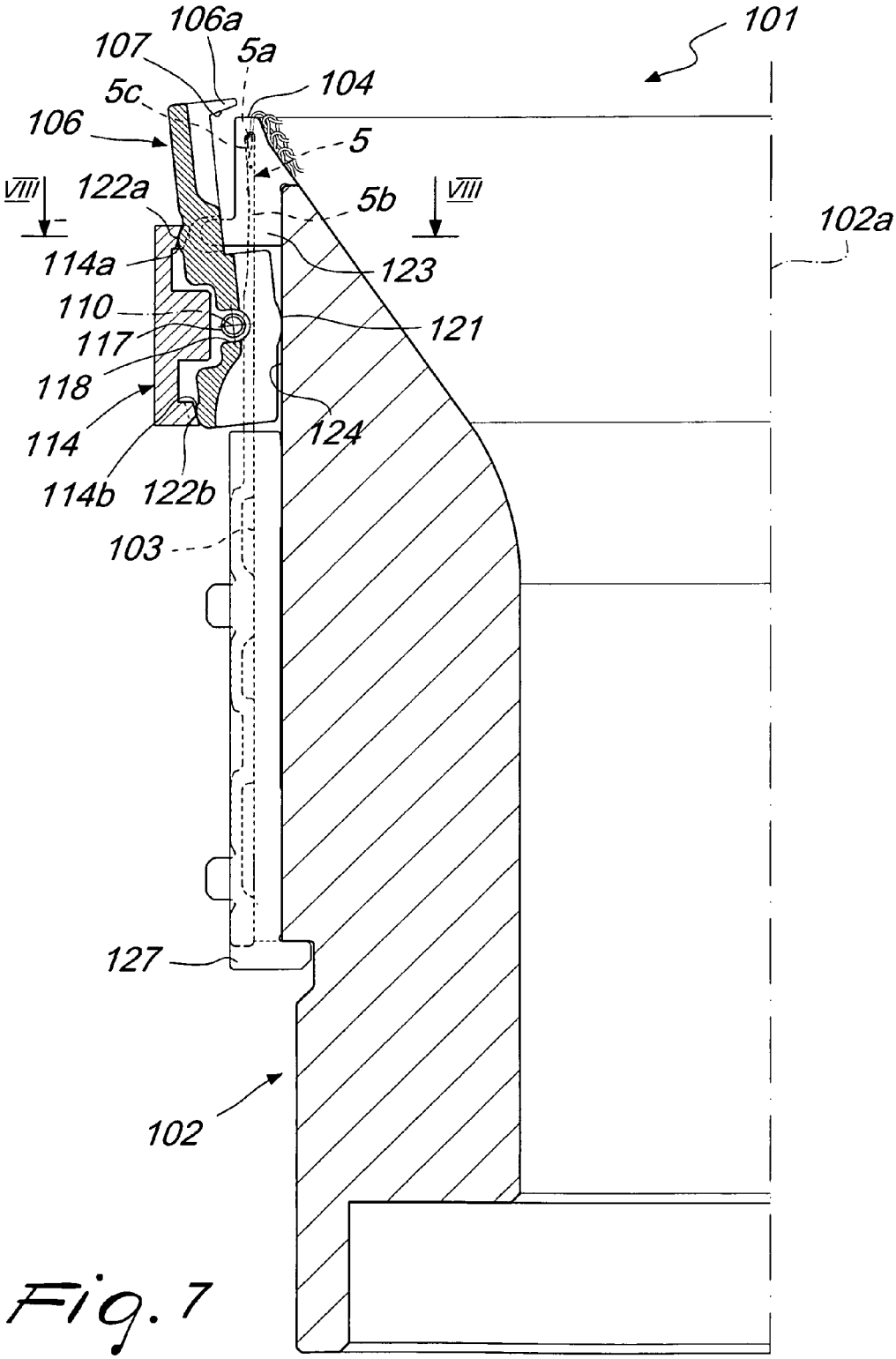
Figure 9:
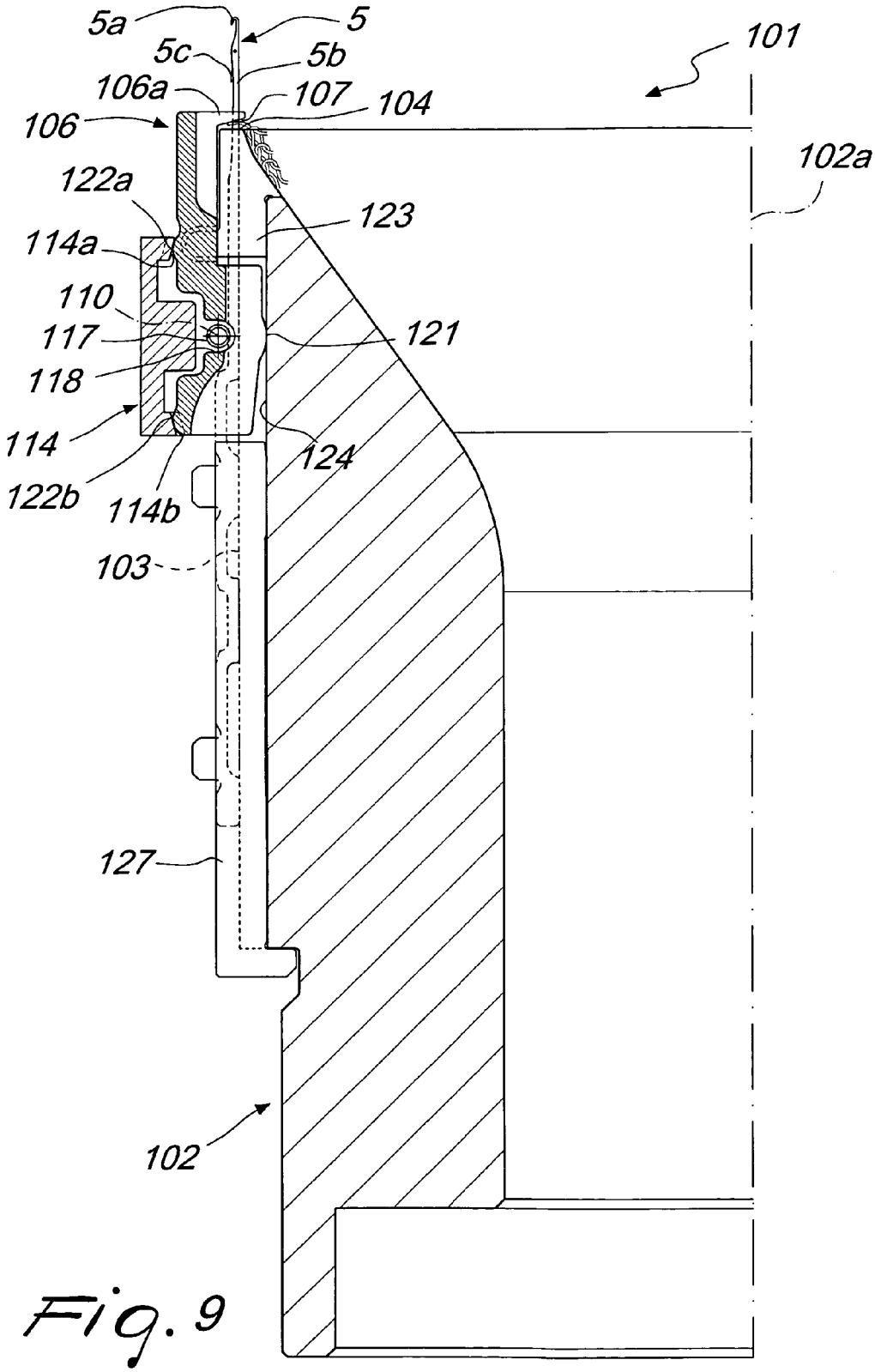
Figure 10:
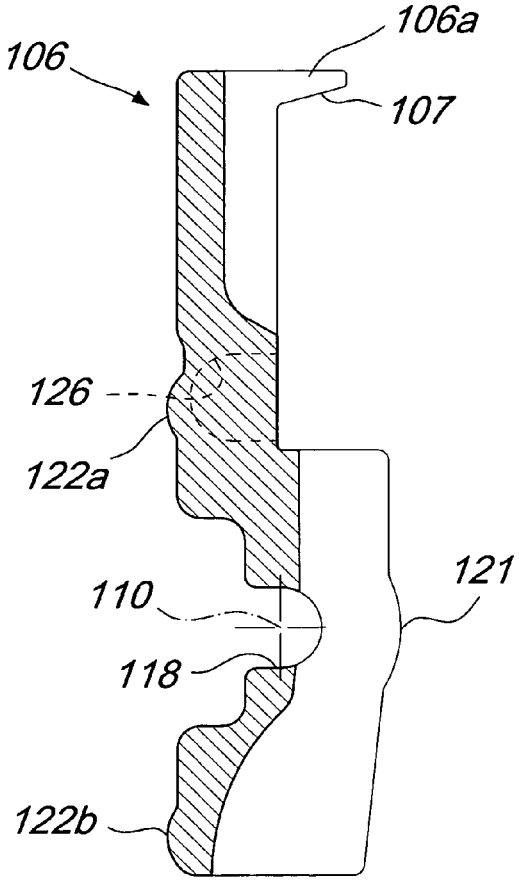
Figure 11:
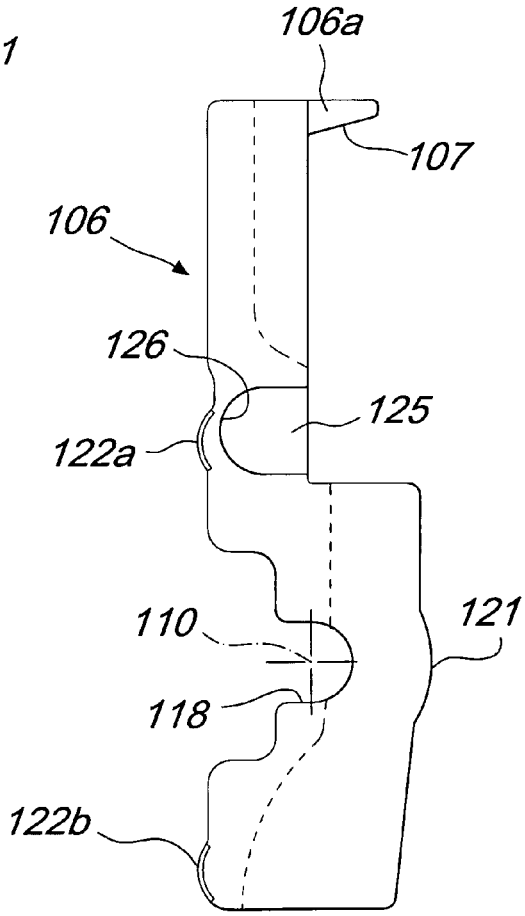

Each knitting retention element 106, 156 is inserted, with its intermediate portion 121, 171, in a slit 124 which accommodates one of the laminas 123 and rests with its intermediate portion 121, 171 on the bottom of the corresponding slit 124, as shown in FIGS. 7 and 9.

Each knitting retention element 106, 156 is shaped so as to be inserted, with its intermediate portion 121, 171, in the slit 124 which accommodates a lamina 123, which is designed to face, with one of its portions, the side, directed away from the needle holder 102, of the lamina 123 which is arranged in said slit 124 and so as to surmount said lamina 123 with its end which constitutes the portion 106*a*, 156*a* which protrudes beyond the knitting forming plane 104.

Each of the laminas 123 has, in a region which is spaced from the knitting forming plane 104, a protrusion 123*a* which protrudes more from the face of the needle holder 102 on which the slots 3 are formed and the knitting retention element 106, 156 is inserted, with a portion 125, 175 thereof, between the protrusions 123*a* of two contiguous laminas 123.

The laminas 123, which delimit the slots 103 laterally, are preferably connected to each other in pairs proximate to their side which is directed away from the needle holder 102 and more specifically at the protrusion 123*a*. Each needle 5 is arranged in each instance between two contiguous laminas 123 which are mutually connected and between two contiguous laminas 123 which are not connected to each other.

In the embodiments shown in FIGS. 5 to 11 and in FIGS. 15 and 16, the knitting retention elements 106 also are connected to each other at least two by two proximate to their side which is directed away from the needle holder 2. In the embodiment shown in FIGS. 5 to 11, the two knitting retention elements 106, which are mutually connected, are arranged in slits 124 which accommodate two laminas 123 which are not mutually connected.

The connection between two laminas 123 and between two or more knitting retention elements 106 is preferably such as to mutually rigidly couple the laminas 123 or the knitting retention elements 106 which are mutually connected. This connection can be performed by providing monolithically, as shown, the two or more elements to be mutually connected or by welding or by means of rivets or pivots or other known types of connecting element.

In this manner, one obtains pairs of knitting retention elements 106 which have, as a whole, an increased thickness and therefore have a greater resistance to deformation during use.

Optionally, in order to further increase the resistance to deformation of the knitting retention elements 106, it is possible to mutually connect even more than two contiguous retention elements 106.

The portion 125 of the knitting retention elements 106 which is inserted between two contiguous laminas, in the embodiments shown in FIGS. 5 to 11 and FIGS. 15 and 16, is constituted by a narrower region of each pair of knitting retention elements 106 which are connected to each other. More particularly, each pair of mutually connected ring knitting retention elements 106 has, on its outer sides, at the protrusion 123*a* of the corresponding laminas 123, a recess 126 which reduces the thickness thereof at the portion 125, which in this manner can be inserted between the two contiguous laminas 123 which are not mutually connected and are arranged in the same slits 124 in which the two mutually connected knitting retention elements 106 are arranged. The insertion of the portion 125 between two contiguous laminas 123 allows to keep the knitting retention elements 106 correctly positioned even during their oscillation about the oscillation axis 110 in the transition from the first position to the second position or vice versa.

It should be noted that the connection in pairs of the laminas 123 and the connection of the knitting retention elements 106 in pairs or more achieves higher resistance to deformation of these elements, which is particularly useful in the case of high-gauge machines, in which the thickness of a single lamina 123 and of a single knitting retention element 106 would indeed be so low as to expose these elements to easy deformations.

Figure 14:
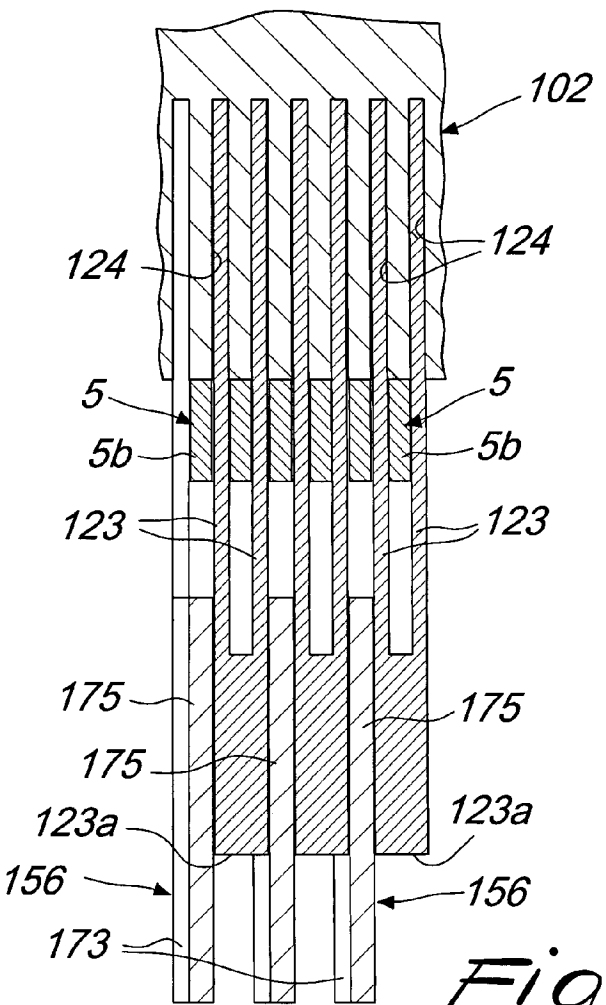
Figure 8:
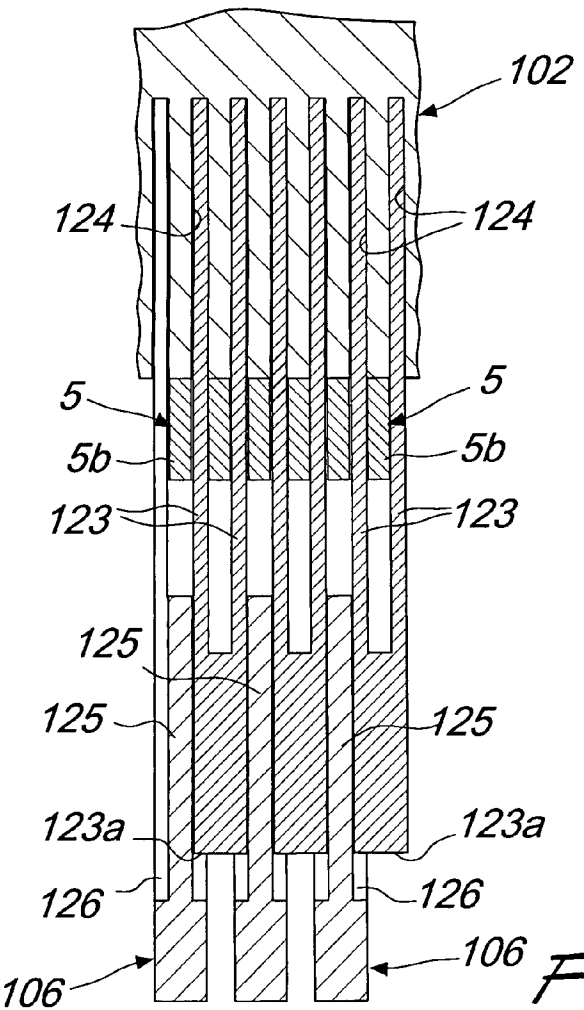
Figure 12:
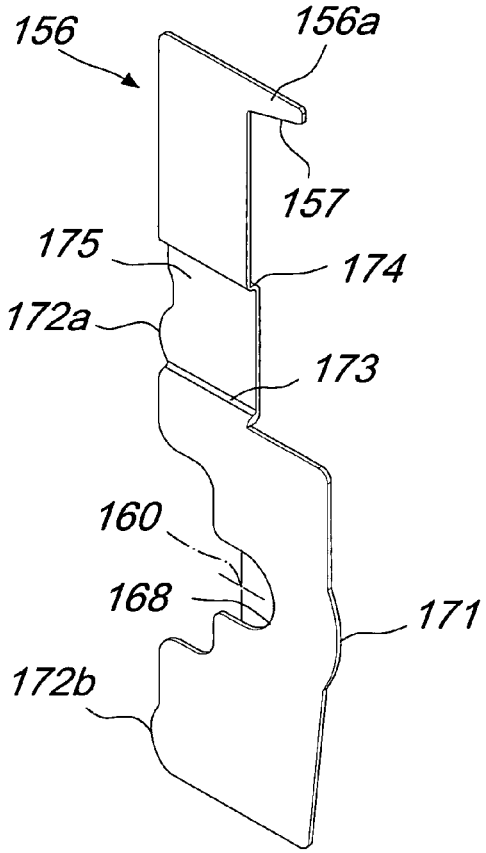
Figure 13:
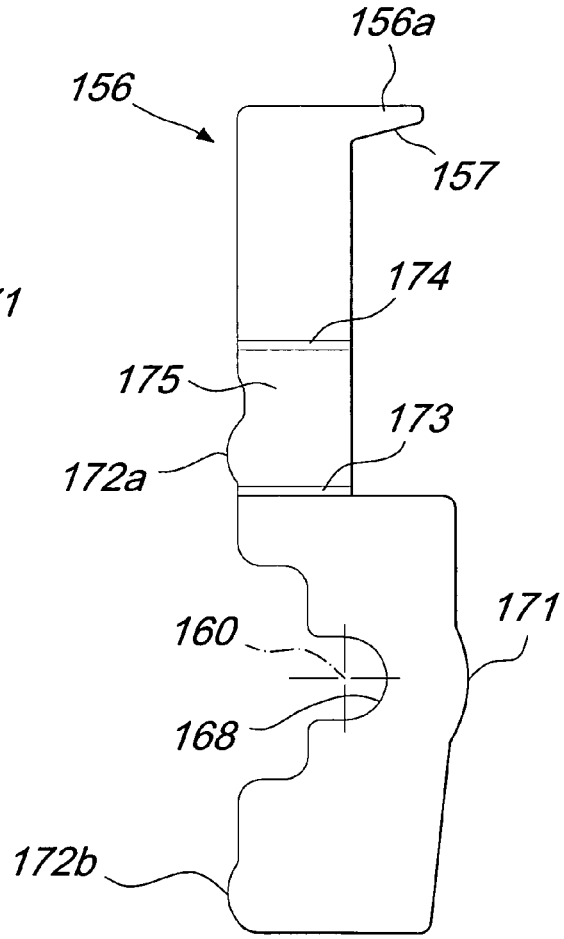

The constructive variation of the knitting retention element 156 shown in FIGS. 12 to 14 is designed to be used preferably with laminas 123 which are not mutually connected in pairs. In this constructive variation, the knitting retention element 156 has, along its longitudinal extension, in the region designed to be at the level of the protrusion 123*a* of the laminas 123, two double folds 173, 174 for placing the portion 175, which lies between these pairs of double folds 173, 174, on a plane which is parallel and spaced laterally with respect to the plane of arrangement of the remaining portion of the knitting retention element 156. In this manner, the portion 175 is arranged laterally with respect to the protrusion 123*a* of the lamina 123 which is arranged in said slit 124 and the portion 175 can be inserted between the protrusion 123*a* of the lamina 123 which arranged in the same slit 124 and the protrusion 123*a* of the contiguous lamina 123.

In this constructive variation also, the insertion of the portion 175 between the protrusions 123*a* of two contiguous laminas 123 allows to keep the knitting retention elements 156 correctly positioned even during their oscillation about the oscillation axis 160 in the transition from the first position to the second position or vice versa.

FIG. 14 illustrates the use of knitting retention elements 156 on a machine which is provided with laminas 123 which are mutually connected in pairs. For this reason, there is a knitting retention element 106 every two laminas 123 which is inserted with its portion 175 between two pairs of laminas 123, each composed of two mutually connected laminas 123. If the laminas 123 are not mutually connected in pairs, it is possible to provide a knitting retention element 156 for each lamina 123. In this case, the knitting retention element 156 is inserted with its portion 175 between two contiguous laminas 123.

In this constructive variation also, the knitting retention elements 156 may be mutually connected in pairs, in threes, or in larger sets.

For the sake of completeness in description, it should be noted that additional laminas 127 are inserted in the slits 124 formed in the body of the needle holder 102 in the regions not occupied by the laminas 123 and by the knitting retention elements 106, 156, and said additional laminas, in said regions, delimit the slots 103 laterally.

It is important to point out that in the machine according to the invention, the knitting retention elements 6, 106, 156 are designed to be arranged at the space comprised between two contiguous slots 3, 103 of the needle holder 2, 102 so as to utilize this space to the benefit of the thickness of the knitting retention elements 6, 106, 156. This refinement, optionally combined with the mutual connection of two or more contiguous knitting retention elements 6, 106, 156, allows to provide knitting retention elements which are sufficiently strong even in high-gauge machines.

The slots 3, 103 inside each of which a needle 5 slides can be delimited laterally by laminas or slats 9, 123, 127 which are inserted in slits or compartments 124 which are formed in the body of the needle holder 2, 102 or by fins which are provided monolithically with the needle holder body 2, 102. In both cases, the knitting retention elements 6, 106, 156 are each arranged at the space comprised between two contiguous slots 3, 103, providing the absence or interruption of the laminas or slats 9, 123, 127 or of the fins at the region occupied by the knitting retention element 6, 106, 156, which may be inserted, with its intermediate portion or wing 16, 121, 171, in the same slits 124 of the needle holder 2, 102 which accommodate the laminas or slats 9, 123, 127 or in slits provided specifically in the body of the needle holder 2, 102, or can also simply rest against the face of the needle holder 2, 102 in the region comprised between two contiguous slots 3, 103 which is not provided with slits 124 and with fins in said region. In this case, the knitting retention elements 6, 106, 156 are in any case guided by the needles 5 and by the optional insertion of the guiding heel 12 or of their portion 125, 175 respectively in the compartment 13 or between the protrusions 123*a* of the laminas 123.

As shown in FIGS. 15 and 16, which refer to a variation of the needle holder 102, the knitting retention elements 106 may also rest on the bottom of a recessed region 102*b* which is formed on the face of the needle holder 102 in which the slots 103 are provided. In FIGS. 15 and 16, the elements of the machine that correspond to elements that have already been described in FIGS. 5 to 11 have been designated by the same reference numerals. It should be noted that knitting retention elements 106 identical to the ones shown in FIGS. 5 to 11 have been shown in FIGS. 15 and 16, but knitting retention elements 156 identical to the ones shown in FIGS. 12 to 14 might also be used.

In all of the embodiments, although preferably, in order to achieve optimum knitting retention, all the regions of the needle holder 2, 102 comprised between two contiguous slots 3, 103 are occupied by a knitting retention element 6, 106, 156, i.e., a knitting retention element 6, 106, 156 is present between two contiguous needles 5, even only some of these regions can be occupied by knitting retention elements 6, 106, 156, i.e., with a knitting retention element 6, 106, 156 every two needles, as shown for example in FIG. 14, or every three needles or more, according to the requirements and the gauge of the machine.

Preferably, the machine according to the invention is constituted by a single-cylinder circular knitting machine, as shown, and the needle holder 2, 102 is constituted by a cylinder which has a vertical axis 2*a*, 102*a* or needle cylinder with the slots 3, 103 formed on its lateral surface and oriented parallel to its axis 2*a*, 102*a*.

In this case, the needle holder 2, 102 can be actuated with a rotary motion about its own axis 2*a*, 102*a* with respect to the actuation cam 14, 114.

Preferably, the machine according to the invention has a gauge comprised substantially between 32 and 60 needles per inch.

Operation of the machine according to the invention as regards the knitting retention elements 6, 106, 156, is as follows.

During the production of knitting, the needles 5 are extracted cyclically with their tip 5*a* and with a portion of their shank 5*b* from the corresponding slot 3, 103 so as to release onto their shank 5*b*, below the latch 5*c*, the previously formed loops of knitting and/or engage the yarn or yarns dispensed at a feed or drop of the machine and are then made to retract into the corresponding slot 3, 103 so as to form new loops of knitting, while the portion of knitting that mutually connects the loops of knitting being formed rests on the knitting forming plane 4, 104. During the retraction movement of the needles 5 into the slots 3, 103, the knitting retention elements 6, 106 or 156 arranged in the regions of the needle holder 2, 102 arranged between the slots 3, 103 are kept in the first position by the contact of the wing 16 against the bottom of the compartment 11 or by the action of the profile 114*b* of the actuation cam 114 on the region 122*b* or 172*b* so as to not interfere with the knitting being formed, as shown in FIGS. 1, 6, 7 and 16.

Figure 2:
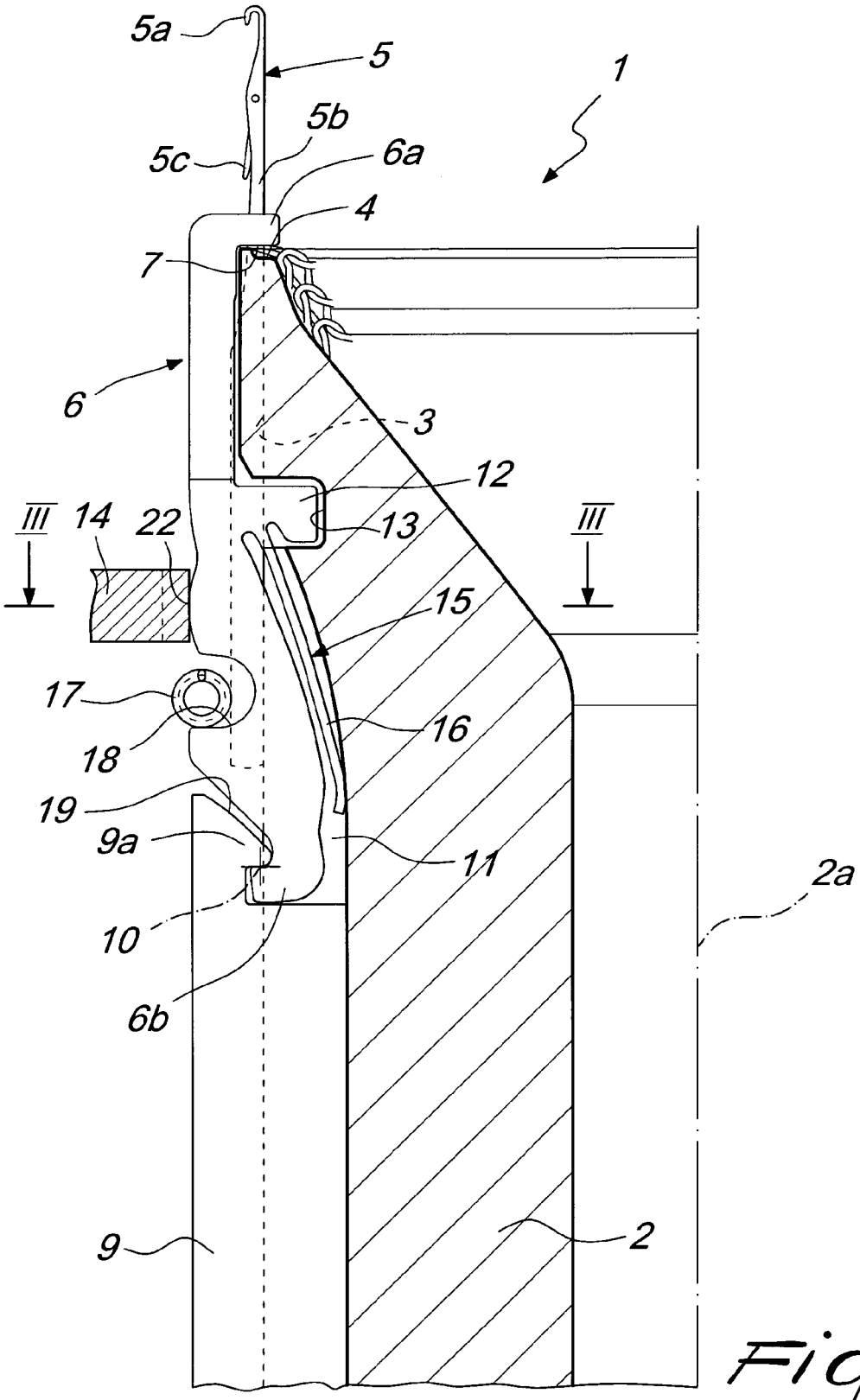

After the needles 5 have retracted into the corresponding slot 3, 103 of the needle holder 2, 102, just before the beginning of their extraction motion or at the beginning of the extraction motion of the needles 5, the knitting retention elements 6, 106 or 156, as a consequence of the action of the profile 14*a* of the actuation cam 14 on the region 22 or of the profile 114*a* of the actuation cam 114 on the region 122*a* or 172*a*, are moved into the second position, so as to make the stop shoulder 7, 107 or 157 face the knitting forming plane 4, 104. In this position, the knitting retention elements 6, 106 or 156 form a sort of comb, which retains the loops of knitting carried by the needles 5, preventing them from following the needles 5 in their extraction motion. In this manner, the loops of knitting are retained proximate to the knitting forming plane 4, 104 while the needles 5 move with their latch 5*c*, which is thus assuredly opened, beyond the loops of knitting retained by the knitting retention elements 6, 106 or 156, as shown in FIGS. 2 and 9.

By virtue of this fact, even in the presence of reduced or insufficient traction of the knitting, correct formation of knitting is achieved, and if the yarn or yarns that feed the needles break it is possible to resume knitting without the need for manual intervention.

In practice it has been found that the machine according to the invention fully achieves the intended aim, since though being provided without sinkers, due to the presence of the knitting retention elements which can be adopted without problems even in the case of high gauges, it ensures correct formation of knitting without thereby imposing a limitation of the active needles, thus allowing to utilize fully its production potential.

In the exemplary embodiments described above, individual characteristics, cited in relation to specific examples, may actually be interchanged with other different characteristics that exist in other exemplary embodiments.

Moreover, it is noted that anything found to be already known during the patenting process is understood not to be claimed and to be the subject of a disclaimer.

The machine thus conceived is susceptible of numerous modifications and variations, all of which are within the scope of the appended claims; all the details may further be replaced with other technically equivalent elements.

The disclosures in Italian Patent Applications no. MI2006A001320 and MI2007A001096, from which this application claims priority, are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

What is claimed is:

1. A knitting machine with latch needles, comprising a needle holder on one face of which there are multiple side-by-side slots which are open at one of their longitudinal ends on a side of the needle holder which defines the knitting forming plane, each slot accommodating a needle which can be actuated with a reciprocating motion along the corresponding slot with an extraction motion, by means of which the needle is extracted from the needle holder with its tip and with a portion of its shank through said longitudinal end of the corresponding slot in order to release, onto its shank, the previously formed loop of knitting and/or engage the yarn or yarns dispensed at a feed or drop of the machine, and with a retraction motion, by means of which the needle is made to retract with its tip into the corresponding slot in order to form a new loop of knitting by lowering the loop of knitting previously formed in order to produce knitting, further comprising, in at least part of the regions of the needle holder comprised between two contiguous slots, elements for retaining the knitting which have a portion which forms a stop shoulder for the knitting, each knitting retention element being movable on command from a first position, in which it does not interfere with the knitting being formed, to a second position, in which it is inserted with said portion between two contiguous needles in a region which faces said knitting forming plane, in order to retain the portion of knitting that lies between two contiguous needles, contrasting the entrainment of the knitting along the needles during the extraction motion of said needles, actuation means being provided for actuating said knitting retention element for its passage from said first position to said second position and vice versa in a manner which is coordinated with the actuation of the contiguous needles wherein each knitting retention element is rigidly connected, proximate to its side directed away from the needle holder, to at least one contiguous knitting retention element.

2. The knitting machine according to claim 1, further comprising a knitting retention element at each of the regions of the needle holder comprised between two contiguous slots.

3. The knitting machine according to claim 1, wherein said knitting retention element has a laminar shape and is arranged on a plane which is parallel to the sides of the slots between which it is arranged; said knitting retention element being able to oscillate on its plane of arrangement in order to pass from said first position to said second position and vice versa.

4. The knitting machine according to claim 2, wherein said knitting retention element is arranged on the face of said needle holder in which there are said slots and lies on a plane which is substantially perpendicular to said face, said knitting retention element having a longitudinal end which forms said portion and protruding beyond said knitting forming plane; said longitudinal end of the knitting retention element protruding toward the needle holder so as to form said stop shoulder with its side directed toward said knitting forming plane.

5. The knitting machine according to claim 2, wherein said knitting retention element is pivoted, at its longitudinal end which lies opposite the portion that defines said stop shoulder, to a slat or lamina which is fixed to said needle holder in the region thereof comprised between two contiguous slots, the pivoting axis of said knitting retention element to said slat being arranged substantially at right angles to the plane of arrangement of said knitting retention element.

6. The knitting machine according to claim 5, wherein the pivoting between said slat and the longitudinal end of the knitting retention element that lies opposite with respect to the portion that forms said stop shoulder is provided by a hook-shaped portion, which is directed toward the needle holder, of the slat which mates with the end, which is correspondingly hook-shaped and directed in the opposite direction with respect to the needle holder, of the knitting retention element.

7. The knitting machine according to claim 5, wherein said actuation means comprise an actuation cam which faces the side of said knitting retention element which is directed away from said needle holder, said needle holder being actuatable along an actuation direction which is substantially perpendicular to the longitudinal extension of said slots with respect to said actuation cam, said actuation cam having an actuation profile which gradually approaches said needle holder along said actuation direction, said actuation profile being engageable with a region of said knitting retention element which is spaced from said pivoting axis in order to actuate the oscillation of said knitting retention element about said pivoting axis for its transition from said first position to said second position.

8. The knitting machine according to claim 5, wherein said actuation means comprise elastic means which contrast elastically the passage of said knitting retention element from said fast position to said second position.

9. The knitting machine according to claim 8, wherein said elastic means comprise an elastically flexible wing, which is provided monolithically with said knitting retention element, said wing protruding from the side of said knitting retention element which is directed toward said a needle holder and resting against said needle holder in the region comprised between two contiguous slots.

10. The knitting machine according to claim 1, wherein said knitting retention element has, in an intermediate region of its longitudinal extension, on its side directed toward said needle holder, a guiding heel which can be inserted, in the transition of said knitting retention element from the first position to the second position, in a compartment which is formed in the face of said needle holder which faces said knitting retention element, said guiding heel, in the transition of said knitting retention element from the first position to the second position and vice versa, sliding between the shanks of the two adjacent needles.

11. The knitting machine according to claim 8, wherein a portion of said knitting retention element starting from its end which is pivoted to said slat is accommodated in a containment compartment which is formed in said needle holder, said wing resting on the bottom of said containment compartment.

12. The knitting machine according to claim 8, further comprising means for retaining said knitting retention element in order to keep it in said containment compartment in contrast with the action of said elastic means.

13. The knitting machine according to claim 6, wherein said retention means comprise a support which is formed by said hook-shaped portion of said slat for the end of the knitting retention element that mates therewith, said support delimiting the arc of rotation of the knitting retention element about said pivoting axis in its transition from the second position to the first position by way of the action of said elastically flexible wing.

14. The knitting machine according to claim 1, wherein said knitting retention element has an intermediate portion which rests against the face of said needle holder in which said slots are formed in the region comprised between two contiguous slots, said intermediate portion forming an axis of oscillation of the knitting retention element with respect to the needle holder, said oscillation axis being oriented substantially at right angles to the plane of arrangement of said knitting retention element, said knitting retention element being able to oscillate about said oscillation axis with respect to said needle holder in order to pass from said first position to said second position or vice versa.

15. The knitting machine according to claim 14, wherein said intermediate portion is shaped like a circular sector.

16. The machine according to claim 14, wherein said knitting retention element rests, with said intermediate portion, against a recessed region of the face of said needle holder in which said slots are formed.

17. The knitting machine according to claim 14, wherein said means for actuating said knitting retention element for its transition from said first position to said second position and vice versa comprise at least one actuation cam which faces the face of the needle holder in which said slots are formed, said needle holder being actuatable along an actuation direction which is substantially perpendicular to the longitudinal extension of said slots with respect to said at least one actuation cam and said at least one actuation cam having a profile which is adapted to act alternately on said knitting retention element in two regions arranged on mutually opposite sides with respect to said oscillation axis in order to produce the oscillation of said knitting retention element about said oscillation axis with respect to said needle holder in one direction or in the opposite direction for the transition of said knitting retention element from said first position to said second position or vice versa.

18. The knitting machine according to claim 14, wherein said slots are delimited transversely, at least proximate to the knitting forming plane, by laminas which are inserted in parallel slits formed in the body of the needle holder, said laminas protruding from the body of the needle holder.

19. The knitting machine according to claim 18, wherein said knitting retention element is inserted, with said intermediate portion, in a slit which accommodates one of said laminas and rests with said intermediate portion on the bottom of said slit.

20. The knitting machine according to claim 18, wherein said knitting retention element faces, with one of its portions, the side directed away from said needle holder of the lamina which is arranged in the same slit in which the intermediate portion of said knitting retention element is inserted and surmounts said lamina with its longitudinal end which protrudes beyond said knitting forming plane.

21. The knitting machine according to claim 18, wherein each of said laminas has, in a region which is spaced from said knitting forming plane, a protrusion which protrudes further from the face of the needle holder in which said slots are formed, said knitting retention element being inserted, with one of its portions, between the protrusions of two contiguous laminas.

22. The knitting machine according to claim 18, wherein said knitting retention element has, along its longitudinal extension, two double folds in order to place its portion which is inserted between the protrusions of two contiguous laminas on a plane which is parallel to, and spaced from, the plane of arrangement of the remaining portion of the knitting retention element which coincides substantially with the plane of arrangement of one of said two laminas.

23. The knitting machine according to claim 18, wherein said laminas, which delimit said slots laterally, are mutually connected in pairs proximate to their side which is directed away from the needle holder, each needle being arranged in each instance between two laminas which are mutually connected and between two laminas which are not mutually connected.

24. The knitting machine according to claim 18, wherein said laminas are mutually rigidly connected in pairs.

25. The knitting machine according to claim 18, wherein each knitting retention element is connected, proximate to its side which is directed away from the needle holder, to at least one contiguous knitting retention element, two mutually connected and contiguous knitting retention elements being accommodated, with their intermediate portion, in two slits of the needle holder which accommodate two laminas which are not mutually connected.

26. The knitting machine according to claim 18, wherein each pair of mutually connected knitting retention elements has, on its outer sides, at the protrusion of the corresponding contiguous laminas, which are arranged in the same slits of the needle holder body which accommodate the two mutually connected knitting retention elements, a recess which forms a portion which has a reduced thickness and is inserted between said two contiguous laminas at the corresponding protrusions.

27. The knitting machine according to claim 1, wherein it has a gauge comprised substantially between 32 and 60 needles per inch.

28. The knitting machine according to claim 1, wherein it is a circular knitting machine, said needle holder being constituted by a cylinder in which said slots formed on its lateral surface and are oriented longitudinally and parallel to the axis of said cylinder.

29. A knitting retention element for a knitting machine with latch needle comprising a needle holder on one face of which there are multiple side-by-side slots which are open at one of their longitudinal ends on a side of the needle holder which defines the knitting forming plane, each slot accommodating a needle which can be actuated with a reciprocating motion along the corresponding slot with an extraction motion, by means of which the needle is extracted from the needle holder with its tip and with a portion of its shank through said longitudinal end of the corresponding slot in order to release, onto its shank, the previously formed loop of knitting and/or engage the yarn or yarns dispensed at a feed or drop of the machine, and with a retraction motion, by means of which the needle is made to retract with its tip into the corresponding slot in order to form a new loop of knitting by lowering the loop of knitting previously formed in order to produce knitting, further comprising, in at least part of the regions of the needle holder comprised between two contiguous slots, said knitting retention element which has a portion which forms a stop shoulder for the knitting, said knitting retention element being movable on command from a first position, in which it does not interfere with the knitting being formed, to a second position, in which it is inserted with said portion between two contiguous needles in a region which faces said knitting forming plane, in order to retain the portion of knitting that lies between two contiguous needles, contrasting the entrainment of the knitting along the needles during the extraction motion of said needles, actuation means being provided for actuating said knitting retention element for its passage from said first position to said second position and vice versa in a manner which is coordinated with the actuation of the contiguous needles wherein the knitting retention element is rigidly connected, proximate to its side directed away from the needle holder, to at least one contiguous knitting retention element.

* * * * *